US009702598B2

(12) United States Patent
Watanabe

(10) Patent No.: US 9,702,598 B2
(45) Date of Patent: Jul. 11, 2017

(54) EVAPORATOR

(71) Applicant: KEIHIN THERMAL TECHNOLOGY CORPORATION, Oyama-shi (JP)

(72) Inventor: Sumitaka Watanabe, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 95 days.

(21) Appl. No.: 14/706,976

(22) Filed: May 8, 2015

(65) Prior Publication Data

US 2015/0330681 A1 Nov. 19, 2015

(30) Foreign Application Priority Data

May 15, 2014 (JP) ..... 2014-101121

(51) Int. Cl.

| | |
|---|---|
| ***F25B 39/02*** | (2006.01) |
| ***F25B 41/06*** | (2006.01) |
| ***F28F 9/02*** | (2006.01) |
| ***F28D 1/03*** | (2006.01) |
| ***F28D 1/053*** | (2006.01) |
| *F28D 21/00* | (2006.01) |

(52) U.S. Cl.

CPC ..... *F25B 39/028* (2013.01); *F25B 39/022* (2013.01); *F25B 41/062* (2013.01); *F28D 1/0316* (2013.01); *F28D 1/05391* (2013.01); *F28F 9/0253* (2013.01); *F25B 2500/01* (2013.01); *F25B 2500/18* (2013.01); *F28D 2021/0085* (2013.01)

(58) Field of Classification Search

CPC .. F25B 41/062; F25B 39/022; F25B 2500/18; F25B 2500/01; F25B 2500/21; F28F 9/005; F28F 9/02; F28D 1/05391

See application file for complete search history.

(56) References Cited

U.S. PATENT DOCUMENTS

| | | | | |
|---|---|---|---|---|
| 2004/0020996 | A1* | 2/2004 | Kobayashi | F25B 41/062 236/92 B |
| 2010/0077794 | A1* | 4/2010 | Higashiyama | F25B 39/022 62/515 |
| 2011/0113823 | A1* | 5/2011 | Joboji | F25B 39/022 62/515 |
| 2013/0312942 | A1* | 11/2013 | Moreau | F28D 1/0341 165/172 |

FOREIGN PATENT DOCUMENTS

| | | |
|---|---|---|
| JP | 5142109 B2 | 4/2010 |

* cited by examiner

*Primary Examiner* — Elizabeth Martin
(74) *Attorney, Agent, or Firm* — Mori & Ward, LLP

(57) ABSTRACT

An evaporator used in a car air conditioner satisfies a a relation of 0.9≤P1/P2≤1.1, where P1 is the passage cross sectional area of each portion of a refrigerant discharge passage of a refrigerant inlet outlet member of the evaporator, and P2 is the passage cross sectional area of a pipe which establishes communication between a second refrigerant passage of an expansion valve and a compressor. Preferably, relations of W1>W2 and H1>H2 are satisfied, where W1 and H1 are the internal width and height of an upstream end portion of a straight portion of an outward bulged portion of a third plate of the refrigerant inlet outlet member, and W2 and H2 are the internal width and height of a downstream end portion of the outward bulged portion.

4 Claims, 7 Drawing Sheets

EVAPORATOR

BACKGROUND OF THE INVENTION

The present invention relates to an evaporator which is suitable for use in a car air conditioner which is a refrigerating cycle mounted on, for example, an automobile.

In the present specification and appended claims, the upper and lower sides of FIGS. 1 and 2 will be referred to as "upper" and "lower," respectively.

The present applicant has proposed an evaporator which can decrease its size and weight, can enhance its performance, and allows an expansion valve attachment member for attaching an expansion valve to be disposed near the evaporator (see Japanese Patent No. 5142109). The proposed evaporator includes a first header section having a refrigerant inlet at one end thereof; a second header section juxtaposed on the windward side of the first header section and having a refrigerant outlet at one end thereof located on the same side as the refrigerant inlet of the first header section; a third header section disposed below the first header section such that the third header section is spaced from the first header section; a fourth header section disposed below the second header section such that the fourth header section is spaced from the second header section and is juxtaposed on the windward side of the third header section; a plurality of heat exchange tubes disposed between the first header section and the third header section and between the second header section and the fourth header section such that the heat exchange tubes are spaced from one another in the longitudinal direction of the header sections and opposite end portions of the heat exchange tubes are connected to the corresponding header sections; a refrigerant inlet outlet member having a refrigerant introduction passage for feeding refrigerant into the refrigerant inlet and a refrigerant discharge passage for discharging the refrigerant from the refrigerant outlet; and an expansion valve attachment member attached to the refrigerant inlet outlet member and having a first refrigerant flow passage communicating with the refrigerant introduction passage of the refrigerant inlet outlet member and a second refrigerant flow passage communicating with the refrigerant discharge passage. The refrigerant inlet outlet member is composed of a first plate extending across and joined to the one end of the first header section and the one end of the second header section, a second plate stacked on and joined to a surface of the first plate opposite the two header sections; and a third plate stacked on and joined to a surface of the second plate opposite the first plate. At least one of the first and third plates is bulged outward, and a cutaway and a through-hole are formed in the second plate, whereby a refrigerant introduction passage and a refrigerant discharge passage are provided. One end of the refrigerant introduction passage communicates with the refrigerant inlet, the other end of the refrigerant introduction passage is opened at a vertically extending edge of the refrigerant inlet outlet member formed by the three plates. One end of the refrigerant discharge passage communicates with the refrigerant outlet, and the other end of the refrigerant discharge passage is opened at the edge of the refrigerant inlet outlet member at which the refrigerant introduction passage is opened. When the refrigerant introduction passage and the refrigerant discharge passage are viewed in a stacking direction in which all the plates are stacked, the refrigerant introduction passage and the refrigerant discharge passage intersect each other without communicating with each other. The refrigerant flowing out from the refrigerant outlet is fed to a compressor through the refrigerant discharge passage of the refrigerant inlet outlet member, one refrigerant flow passage of the expansion valve attachment member, one passage of an expansion valve attached to the expansion valve attachment member, and a pipe for establishing communication between the one passage of the expansion valve and the compressor. A portion of the refrigerant discharge passage of the refrigerant inlet outlet member, which portion is located on the downstream side in a refrigerant flow direction and has a predetermined length, is formed by outward bulged portions of the first plate and the third plate and bulging outward in the stacking direction of the three plates. The remaining portion of the refrigerant discharge passage is formed by an outward bulged portion of the third plate and bulging outward in the stacking direction of the three plates.

In the evaporator disclosed in the above-mentioned publication, in order to suppress an increase in pressure loss on the refrigerant side, at a part of the portion of the refrigerant discharge passage of the refrigerant inlet outlet member formed by the outward bulged portion of the third plate only, the internal width of the outward bulged portion is increased so as to increase the passage cross sectional area of that part. However, in the case where the thicknesses of the three plates of the refrigerant inlet outlet member are reduced to decrease the weight of the evaporator, when the internal width of a part of the outward bulged portion of the third plate is increased as described above, the strength against the pressure inside the refrigerant discharge passage may decrease.

SUMMARY OF THE INVENTION

An object of the present invention is to solve the above-mentioned problem and to provide an evaporator which can suppress an increase in pressure loss on the refrigerant side and can suppress a decrease in the strength against the pressure inside a refrigerant discharge passage of a refrigerant inlet outlet member.

An evaporator according to the present invention comprises a first header section having a refrigerant inlet at one end thereof; a second header section disposed to be located adjacent to the first header section in an air-passing direction and having a refrigerant outlet at one end thereof located on the same side as the refrigerant inlet of the first header section; a refrigerant inlet outlet member having a refrigerant introduction passage for feeding refrigerant into the refrigerant inlet and a refrigerant discharge passage for discharging the refrigerant from the refrigerant outlet; and an expansion valve attachment member joined to the refrigerant inlet outlet member and having a first refrigerant flow passage for feeding into the refrigerant introduction passage of the refrigerant inlet outlet member the refrigerant having passed through a first refrigerant passage of an expansion valve and a second refrigerant flow passage for feeding into a second refrigerant passage of the expansion valve the refrigerant discharged from the refrigerant discharge passage of the refrigerant inlet outlet member. The refrigerant inlet outlet member is composed of a first plate extending across and joined to the one end of the first header section and the one end of the second header section, a second plate stacked on and joined to a surface of the first plate opposite the two header sections, and a third plate stacked on and joined to a surface of the second plate opposite the first plate. The first and third plates are bulged outward such that bulged portions of the first plate overlap at least partially with bulged portions of the third plate. The second plate has through-hole-shaped communication portions for establishing communications between the outward bulged portions of the first plate and those of the third plate at required positions. Thus, a refrigerant introduction passage and a refrigerant discharge passage are provided in such a manner that when the refrigerant introduction passage and the refrigerant discharge passage are viewed in a stacking direction in which all the plates are stacked, the refrigerant introduction passage and the refrigerant discharge passage intersect each other without communicating with each other. The refrigerant flows out from the refrigerant outlet of the second header section being fed to a compressor through the refrigerant discharge passage of the refrigerant inlet outlet member, the second refrigerant flow passage of the expansion valve attachment member, the second refrigerant passage of the expansion valve attached to the expansion valve attachment member, and a pipe for establishing communication between the second refrigerant passage of the expansion valve and the compressor. A portion of the refrigerant discharge passage of the refrigerant inlet outlet member located on the downstream side in the refrigerant flow direction and having a predetermined length is defined by outward bulged portions provided in the first plate and the third plate and bulging outward in the stacking direction of the three plates. The remaining portion of the refrigerant discharge passage is defined by an outward bulged portion provided in the third plate only and bulging outward in the stacking direction of the three plates. The outward bulged portion of the third plate of the refrigerant inlet outlet member which defines the refrigerant discharge passage has a straight portion on the upstream side in the refrigerant flow direction, the straight portion having a predetermined length and a fixed internal width over the entire length. The refrigerant outlet of the second header section faces the interior of the straight portion of the outward bulged portion of the third plate. A relation of $0.9 \leq P1/P2 \leq 1.1$ is satisfied, where P1 is the passage cross sectional area ($mm^2$) of each portion of the refrigerant discharge passage of the refrigerant inlet outlet member, and P2 is the passage cross sectional area ($mm^2$) of the pipe which establishes communication between the second refrigerant passage of the expansion valve and the compressor.

DESCRIPTION OF THE PREFERRED EMBODIMENT

An embodiment of the present invention will next be described with reference to the drawings.

In the embodiment described below, the evaporator according to the present invention is applied to an evaporator of a car air conditioner using fluorocarbon refrigerant, and a connection apparatus for the evaporator is an expansion valve attachment member.

In the following description, the term "aluminum" encompasses aluminum alloys in addition to pure aluminum. Also, in the following description, the downstream side with respect to the flow direction of air passing through air-passing clearances between adjacent heat exchange tubes (a direction represented by arrow X in FIG. 1; the right side of FIG. 2) will be referred to as the "front," the opposite side as the "rear," and the left-hand and right-hand sides as viewed frontward from the rear side (the left-hand and right-hand sides of FIG. 1) will be referred to as the "left side" and "right side," respectively.

Figure 1:
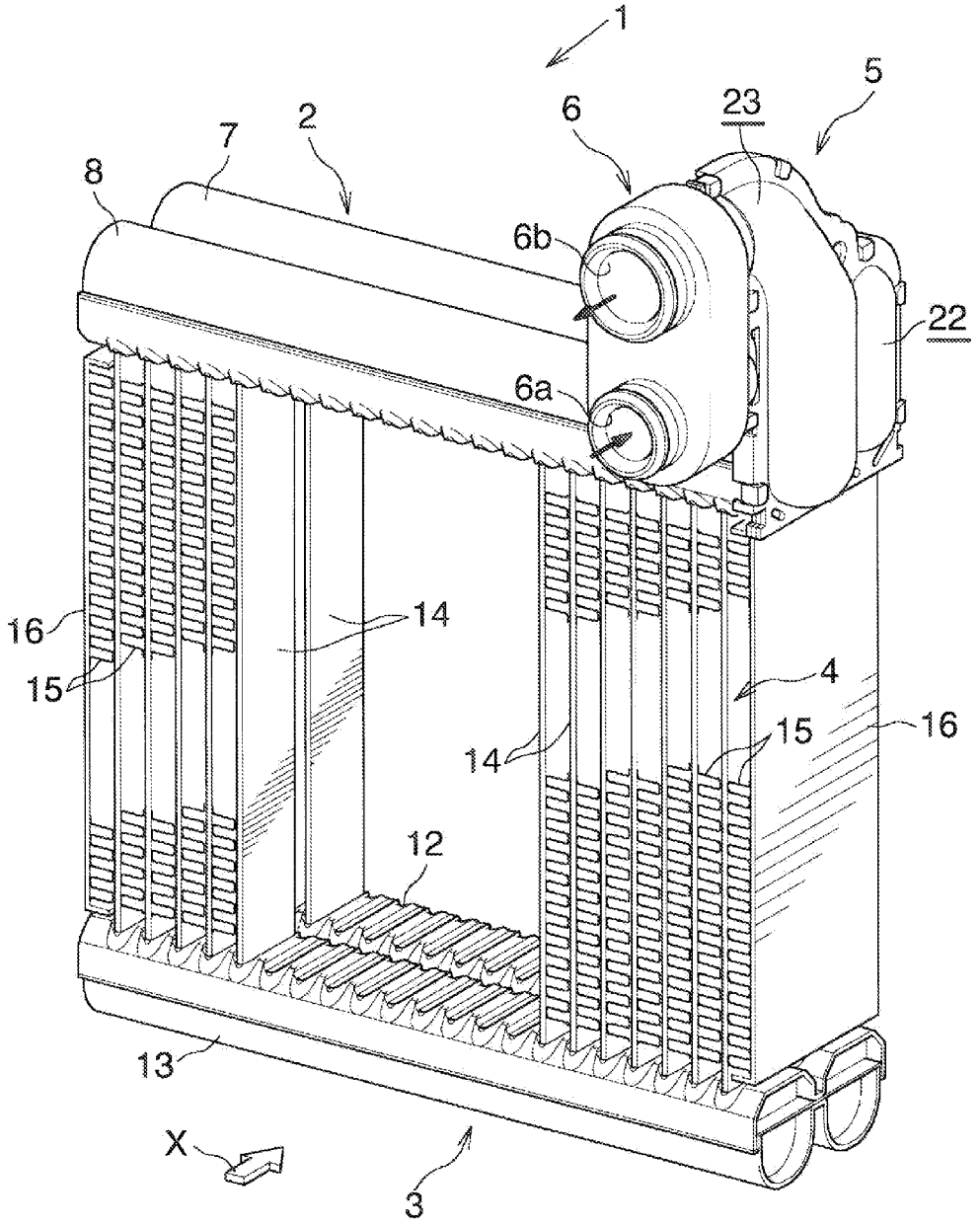
FIG. 1 is a partially omitted perspective view showing the overall structure of an evaporator to which the evaporator of the present invention is applied.

FIG. 1 shows the overall configuration of an evaporator, and FIGS. 2 through 9 show the configuration of an essential portion of the evaporator.

Figure 2:
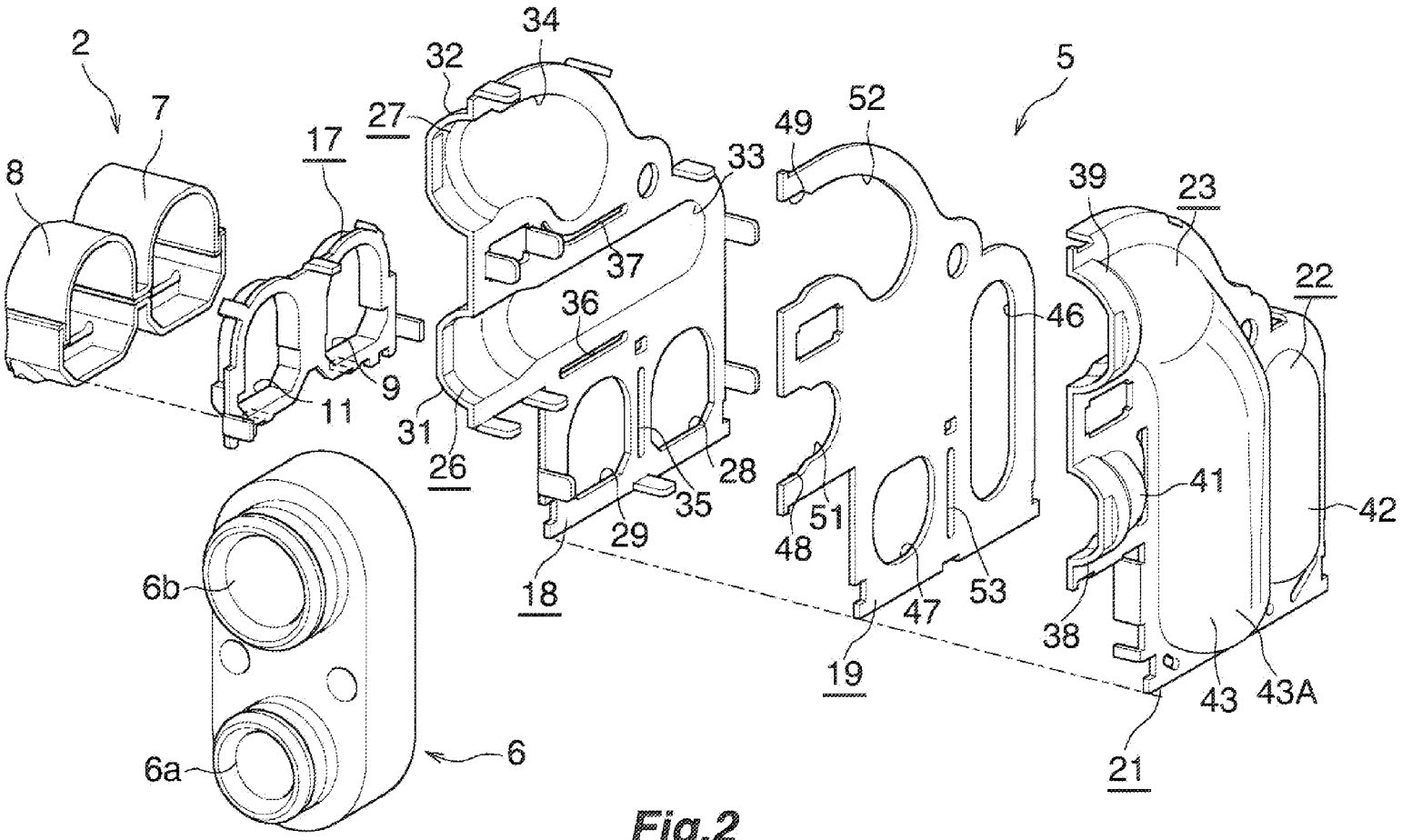
FIG. 2 is an exploded perspective view showing a portion of a first header tank, a refrigerant inlet outlet member, and an expansion valve attachment member of the evaporator of FIG. 1.
Figure 3:
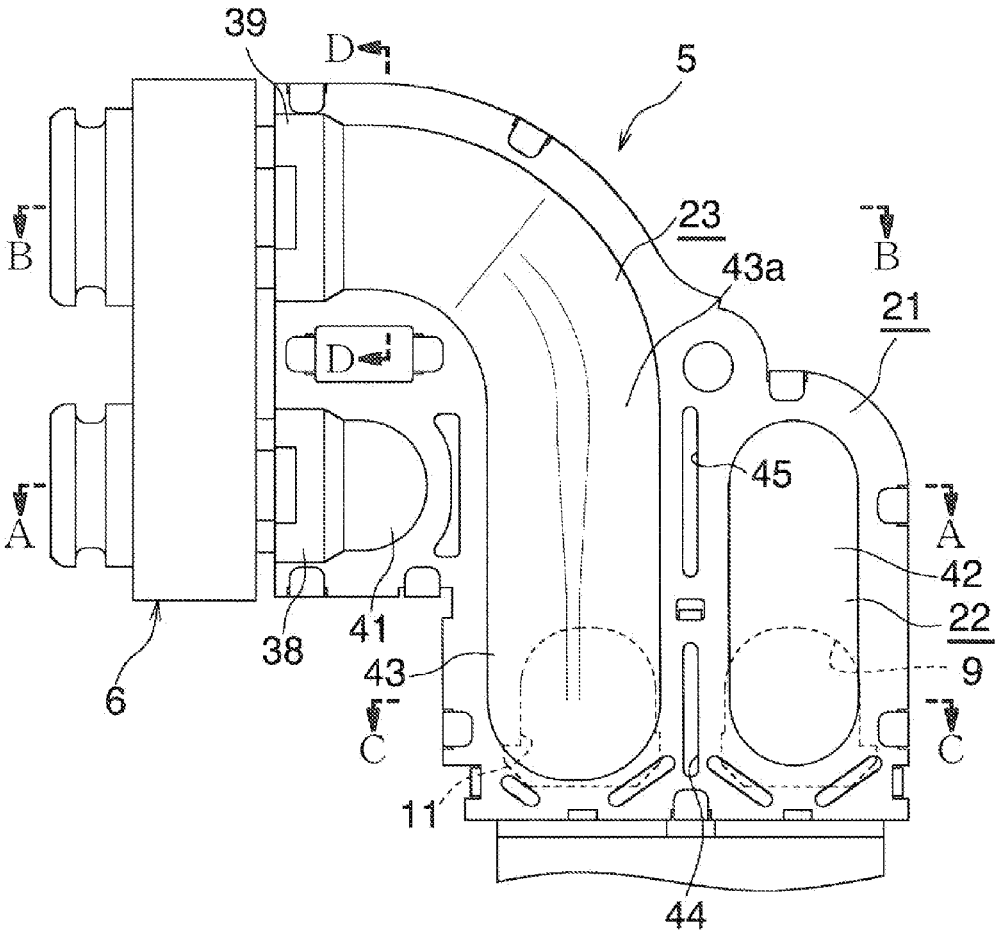
FIG. 3 is a right side view showing a portion of the evaporator of FIG. 1.
Figure 4:
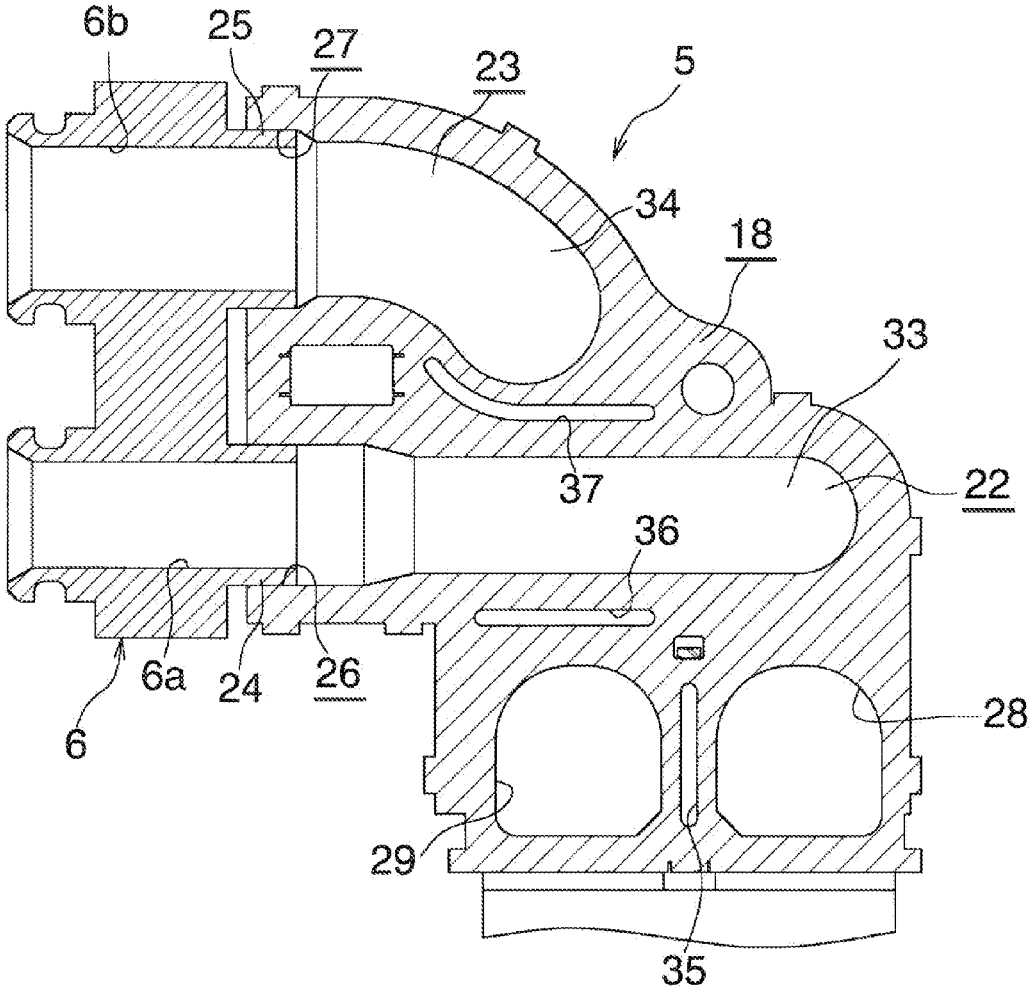
FIG. 4 is a partially omitted vertical cross-sectional view of the refrigerant inlet outlet member of the evaporator of FIG. 1 taken at the position of the first plate and viewed from the right side.
Figure 5:
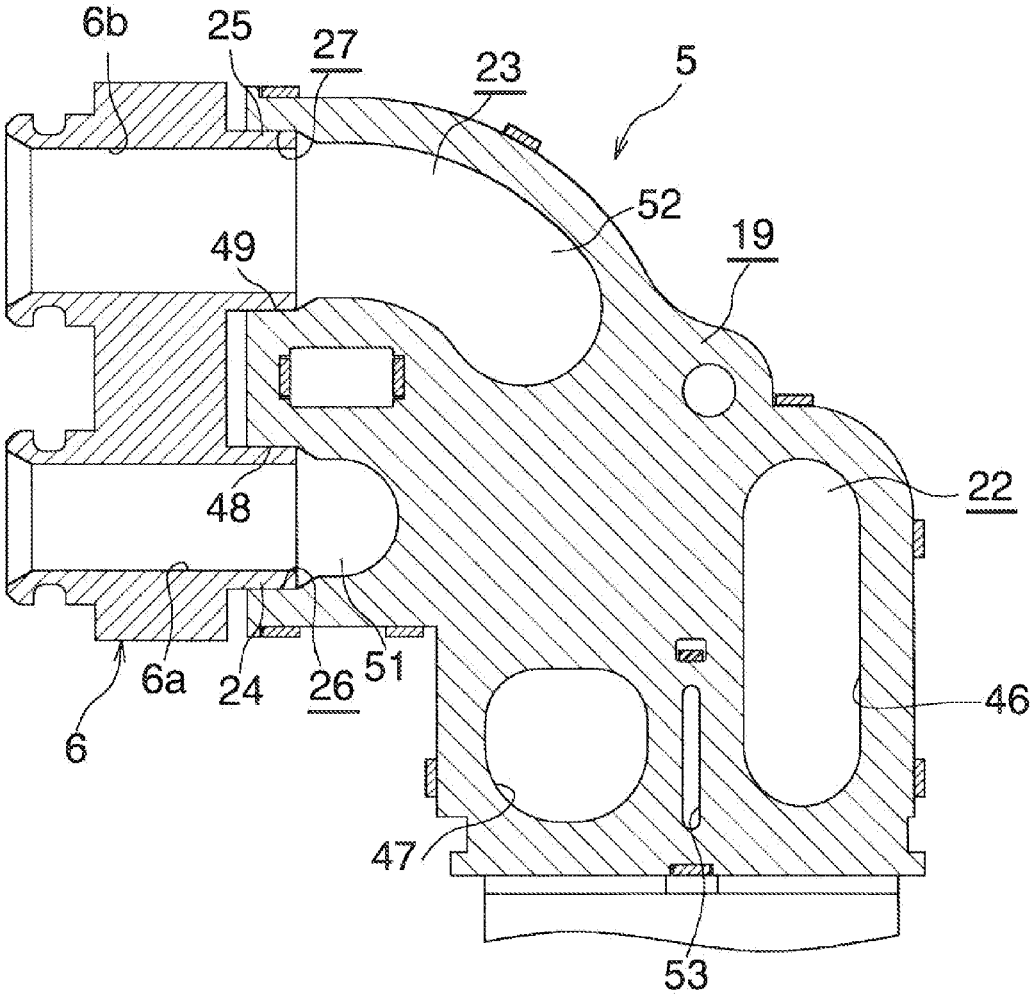
FIG. 5 is a partially omitted vertical cross-sectional view of the refrigerant inlet outlet member of the evaporator of FIG. 1 taken at the position of the second plate and viewed from the right side.
Figure 6:
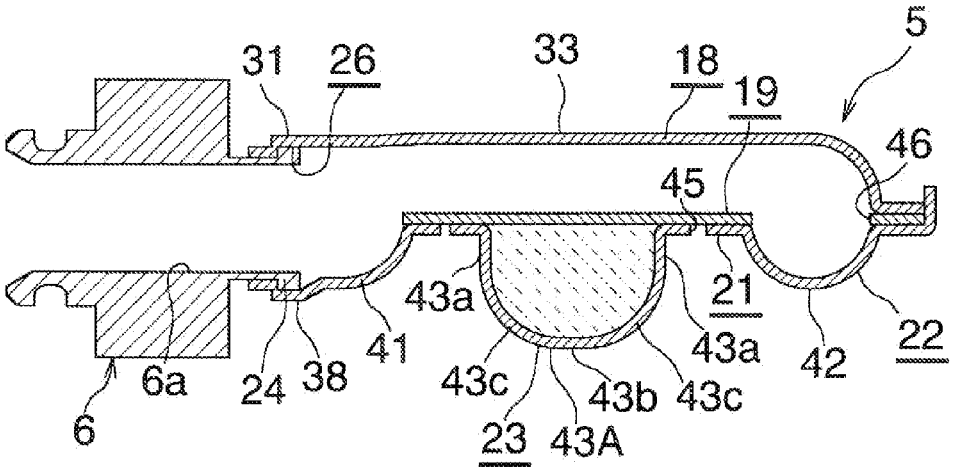
FIG. 6 is a sectional view taken along line A-A of FIG. 3.
Figure 7:
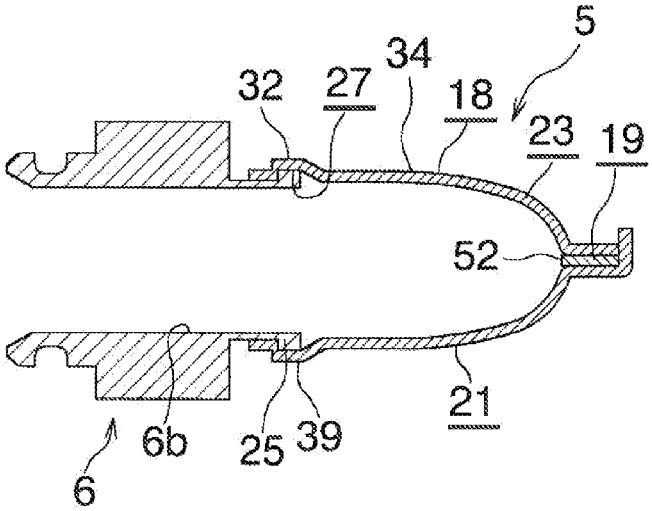
FIG. 7 is a sectional view taken along line B-B of FIG. 3.
Figure 8:
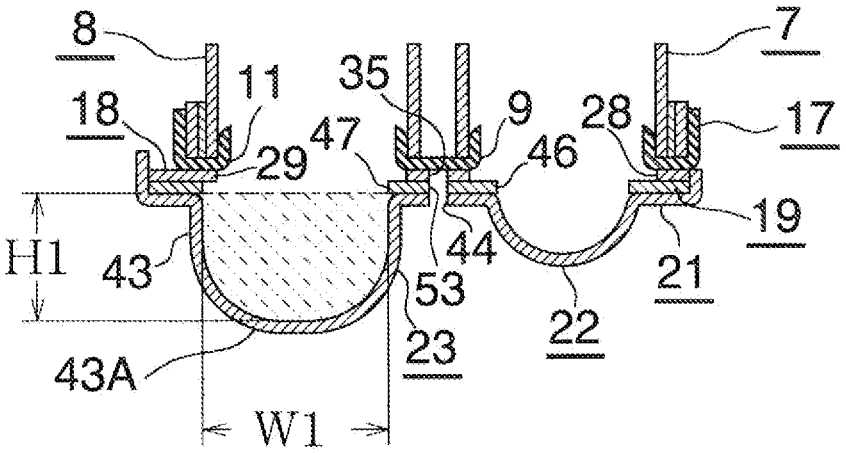
FIG. 8 is a sectional view taken along line C-C of FIG. 3.
Figure 9:
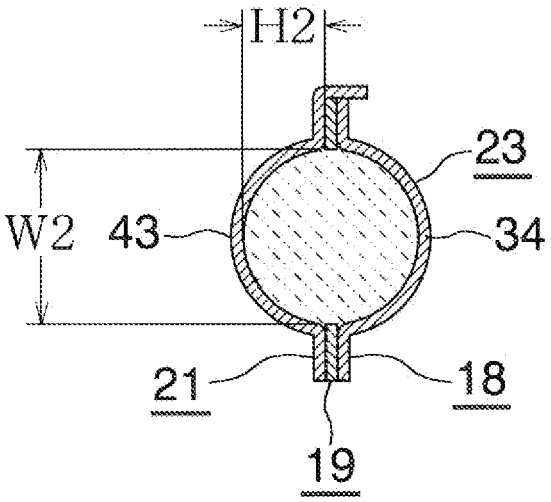
FIG. 9 is a sectional view taken along line D-D of FIG. 3.

As shown in FIGS. 1 through 3, an evaporator 1 used in a car air conditioner using fluorocarbon refrigerant includes a first header tank 2 and a second header tank 3 formed of aluminum and disposed apart from each other in the vertical direction; a heat exchange core section 4 provided between the two header tanks 2 and 3; a refrigerant inlet outlet member 5 formed of aluminum and having a lower portion joined to a right end portion of the first header tank 2; and an expansion valve attachment member 6 formed of aluminum and joined to the refrigerant inlet outlet member 5.

The first header tank 2 includes a first header section 7 whose longitudinal direction coincides with the left-right direction, and a second header section 8 which is disposed on the upstream side of the first header section 7 with respect to the air-passing direction in a state in which the longitudinal direction of the second header section 8 coincides with the left-right direction. A refrigerant inlet 9 is provided at the right end of the first header section 7, and a refrigerant outlet 11 is provided at the right end of the second header section 8 (at the end on the same side as the refrigerant inlet 9 of the first header section 7). At the right end of the first header tank 2, an end member 17 formed of aluminum extends across the first header section 7 and the second header section 8 and are fixed thereto. The refrigerant inlet 9 is formed in a front portion of the end member 17, and the refrigerant outlet 11 is formed in a rear portion of the end member 17.

The second header tank 3 includes a third header section 12 disposed below the first header section 7 such that the third header section 12 is spaced from the first header section 7 and its longitudinal direction coincides with the left-right direction, and a fourth header section 13 which is disposed on the upstream side of the third header section 12 with respect to the air-passing direction in a state in which the longitudinal direction of the fourth header section 13 coincides with the left-right direction.

The heat exchange core section 4 includes a plurality of flat heat exchange tubes 14 formed of aluminum, corrugated fins 15 formed of aluminum, and side plates 16 formed of aluminum. The heat exchange tubes 14 are disposed between the first header section 7 and the third header section 12 and between the second header section 8 and the fourth header section 13 in such a manner that they extend in the vertical direction, their width direction coincides with the air-passing direction, and they are spaced from one another in the left-right direction. Upper and lower end portions of the heat exchange tubes 14 are connected to the header sections 7 and 12 and the header sections 8 and 13, respectively. Each of the corrugated fins 15 is disposed in an air-passing clearance between adjacent heat exchange tubes 14 or on the outer side of each of the heat exchange tubes 14 at the left and right ends of the core section in such a manner that each corrugated fin 15 extends across and is shared by two heat exchange tubes 14 juxtaposed in the air-passing direction. Each of the corrugated fins 15 is brazed to the corresponding heat exchange tubes 14. The side plates 16 are disposed on the outer sides of the corrugated fins 15 at the left and right ends and are brazed to the corrugated fins 15.

The refrigerant inlet outlet member 5 is composed of first through third vertical plates 18, 19, and 21 formed of aluminum. The first header section 7 is located on the left side (the side closer to the first header tank 2), and is brazed to the right end of the first header section 7 and the right end of the second header section 8 in such a manner that the first header section 7 extends across the two right ends. The second plate 19 is stacked and brazed to a surface (right-hand surface) of the first plate 18 opposite the two header sections 7 and 8. The third plate 21 is stacked and brazed to a surface of the second plate 19 opposite the first plate 18. Since the first through third plates 18, 19, and 21 are disposed perpendicular to the longitudinal directions of the first and second header sections 7 and 8, the windward edges of the first through third plates 18, 19, and 21; i.e., the windward edge of the refrigerant inlet outlet member 5, extends in the vertical direction. The refrigerant inlet outlet member 5 has a refrigerant introduction passage 22 for feeding refrigerant into the refrigerant inlet 9 of the first header section 7, and a refrigerant discharge passage 23 for discharging the refrigerant from the refrigerant outlet 11 of the second header section 8. When the refrigerant introduction passage 22 and the refrigerant discharge passage 23 are viewed in the stacking direction in which the plates 18, 19, and 21 are stacked; i.e., viewed from the left side or right side, the refrigerant introduction passage 22 and the refrigerant discharge passage 23 intersect each other without communicating with each other.

The expansion valve attachment member 6 has a first refrigerant flow passage 6*a* and a second refrigerant flow passage 6*b* formed therein such that the former is located below the latter. The first refrigerant flow passage 6*a* extends in the front-rear direction, and is opened at the front and rear ends thereof. The first refrigerant flow passage 6*a* feeds into the refrigerant introduction passage 22 of the refrigerant inlet outlet member 5 the refrigerant having passed through a first refrigerant passage of an expansion valve (not shown). The second refrigerant flow passage 6*b* extends in the front-rear direction and is opened at the front and rear ends thereof. The second refrigerant flow passage 6*b* feeds into a second refrigerant passage of the expansion valve the refrigerant discharged from the refrigerant discharge passage 23 of the refrigerant inlet outlet member 5. The expansion valve attachment member 6 has circular tubular fitting protrusions 24 and 25 integrally formed around the front end openings (openings on the side closer to the refrigerant inlet outlet member 5) of the first and second refrigerant flow passages 6*a* and 6*b* (see FIGS. 4 through 7). The fitting protrusions 24 and 25 are fitted into fitting concave portions 26 and 27 of the refrigerant inlet outlet member 5.

In the above-described evaporator 1, the refrigerant supplied from a condenser through the first refrigerant passage of the expansion valve flows through the first refrigerant flow passage 6*a* of the expansion valve attachment member 6 and the refrigerant introduction passage 22 of the refrigerant inlet outlet member 5, and enters the first header section 7 through the refrigerant inlet 9. The refrigerant flowing out from the second header section 8 through the refrigerant outlet 11 is supplied to a compressor through the refrigerant discharge passage 23 of the refrigerant inlet outlet member 5, the second refrigerant flow passage 6*b* of the expansion valve attachment member 6, the second refrigerant passage of the expansion valve, and a pipe (not shown) for establishing communication between the second refrigerant passage of the expansion valve and the compressor.

Next, the refrigerant inlet outlet member 5 will be described in detail with reference to FIGS. 2 through 9.

The refrigerant inlet outlet member 5 has the fitting concave portion 26 into which the fitting protrusion 24 of the expansion valve attachment member 6 for the first refrigerant flow passage 6*a* is fitted, and the fitting concave portion 27 into which the fitting protrusion 25 of the expansion valve attachment member 6 for the second refrigerant flow passage 6*b* is fitted. One end of the fitting concave portion 26 is opened at the windward edge of the refrigerant inlet outlet member 5, and the other end of the fitting concave portion 26 communicates with the refrigerant introduction passage 22. One end of the fitting concave portion 27 is opened at the windward edge of the refrigerant inlet outlet member 5, and the other end of the fitting concave portion 27 communicates with the refrigerant discharge passage 23.

The first plate 18 of the refrigerant inlet outlet member 5 has a first communication opening 28 in the form of a through-hole which communicates with the refrigerant inlet 9 of the first header section 7; a second communication opening 29 in the form of a through-hole which communicates with the refrigerant outlet 11 of the second header section 8; a lower fitting concave portion forming first outward bulged portion 31 whose one end is opened at the rear edge of the first plate 18 at an intermediate vertical position; an upper fitting concave portion forming first outward bulged portion 32 whose one end is opened at the rear edge of the first plate 18 at a vertical position higher than the vertical position of the lower fitting concave portion forming first outward bulged portion 31; an introduction passage forming first outward bulged portion 33 which has a substantially semi-circular transverse cross section, whose one end connects with the lower fitting concave portion forming first outward bulged portion 31, which extends straight toward the front side, and whose other end is located near the front edge of the first plate 18; and a discharge passage forming first outward bulged portion 34 which has a semi-circular transverse cross section, whose one end connects with the upper fitting concave portion forming first outward bulged portion 32, which extends straight toward the front side, and whose other end is located at an intermediate portion of the first plate 18 in the front-rear direction. The discharge passage forming first outward bulged portion 34 is composed of a short straight portion which connects with the upper fitting concave portion forming first outward bulged portion 32 and extends straight toward the leeward side, and a curved portion which connects with an end of the short straight portion on the leeward side and is curved downward. Slits 35, 36, and 37 are formed respectively in a portion of the first plate 18 between the first communication opening 28 and the second communication opening 29, a portion of the first plate 18 between the second communication opening 29 and the introduction passage forming first outward bulged portion 33, and a portion of the first plate 18 between the introduction passage forming first outward bulged portion 33 and the discharge passage forming first outward bulged portion 34.

The third plate 21 of the refrigerant inlet outlet member 5 has a lower fitting concave portion forming second outward bulged portion 38 which is located at a position corresponding to the lower fitting concave portion forming first outward bulged portion 31 of the first plate 18 and whose one end is opened at the rear edge of the third plate 18; an upper fitting concave portion forming second outward bulged portion 39 which is located at a position corresponding to the upper fitting concave portion forming first outward bulged portion 32 of the first plate 18 and whose one end is opened at the rear edge of the third plate 18; an introduction passage forming second outward bulged portion 41 which has a semi-circular transverse cross section, whose one end connects to the lower fitting concave portion forming second outward bulged portion 38, which extends frontward, and whose front end is located on the upper side and the rear side of the second communication opening 29 of the first plate 18; an introduction passage forming third outward bulged portion 42 which extends straight in the vertical direction and has a substantially semi-circular transverse cross section, whose one end is located at a position corresponding to the first communication opening 28 of the first plate 18, and whose other end is located at a position corresponding to the front end of the introduction passage forming first outward bulged portion 33 of the first plate 18, and a discharge passage forming second outward bulged portion 43 which has a substantially semi-circular transverse cross section, whose one end is located at a position corresponding to the second communication opening 29 of the first plate 18, and whose other end connects to the upper fitting concave portion forming second outward bulged portion 39. The discharge passage forming second outward bulged portion 43 has a straight portion 43A which is located on the upstream side in the refrigerant flow direction, has a predetermined length, and has a fixed internal width over the entire length. The refrigerant outlet 11 of the second header section 8 faces the interior of the straight portion 43A of the discharge passage forming second outward bulged portion 43 of the third plate 21. Also, the third plate 21 has two slits 44 and 45 for preventing formation of a short circuit which are formed between the introduction passage forming third outward bulged portion 42 and the discharge passage forming second outward bulged portion 43 at an interval in the vertical direction in such a manner that the former is located below the latter. The lower-side slit 44 is formed at a position corresponding to the slit 35 between the two communication openings 28 and 29 of the first plate 18.

The second plate 19 of the refrigerant inlet outlet member 5 has a first communication portion 46 (through-hole-shaped communication portion) in the form of a through-hole which extends in the vertical direction, whose one end is located at a position corresponding to the first communication opening 28 of the first plate 18 and to the lower end of the introduction passage forming third outward bulged portion 42 of the third plate 21, and whose other end is located at a position corresponding to the front end of the introduction passage forming first outward bulged portion 33 of the first plate 18 and to the upper end of the introduction passage forming third outward bulged portion 42 of the third plate 21, and which establishes communication between the first communication opening 28 and the introduction passage forming first outward bulged portion 33, and the introduction passage forming third outward bulged portion 42; a second communication portion 47 in the form of a through-hole which is located at a position corresponding to the second communication opening 29 of the first plate 18 and which establishes communication between the second communication opening 29 of the first plate 18 and the lower end of the discharge passage forming second outward bulged portion 43 of the third plate 21; a third communication portion 48 in the form of a through-hole which is located at a position corresponding to the lower fitting concave portion forming first outward bulged portion 31 of the first plate 18 and the lower fitting concave portion forming second outward bulged portion 38 of the third plate 21, which is opened at the rear edge of the second plate 19, and which establishes communication between the two outward bulged portions 31 and 38; a fourth communication portion 49 in the form of a through-hole which is located at a position corresponding to the upper fitting concave portion forming first outward bulged portion 32 of the first plate 18 and the upper fitting concave portion forming second outward bulged portion 39 of the third plate 21, which is opened at the rear edge of the second plate 19, and which establishes communication between the two outward bulged portions 32 and 39; a fifth communication portion 51 in the form of a through-hole which connects to the front end of the third communication portion 48, is located at a position corresponding to the introduction passage forming second outward bulged portion 41 of the third plate 21, and which establishes communication between the rear end of the introduction passage forming first outward bulged portion 33 of the first plate 18 and the introduction passage forming second outward bulged portion 41 of the third plate 21; and a sixth communication portion 52 in the form of a through-hole which connects to the front end of the fourth communication portion 49, is located at a position corresponding to the discharge passage forming first outward bulged portion 34 of the first plate 18, and which establishes communication between the discharge passage forming first outward bulged portion 34 of the first plate 18 and the discharge passage forming second outward bulged portion 43 of the third plate 21. Also, the second plate 19 has a slit 53 for preventing formation of a short circuit which is formed in the second plate 19 at a position corresponding to the slit 35 of the first plate 18 between the two communication openings 28 and 29.

Accordingly, the downstream portion of the refrigerant discharge passage 23 of the refrigerant inlet outlet member 5 having the predetermined length is formed by the discharge passage forming first outward bulged portion 34 of the first plate 18 and a portion of the discharge passage forming second outward bulged portion 43 of the third plate 21, and the remaining portion of the refrigerant discharge passage 23 is formed by the remaining portion of the discharge passage forming second outward bulged portion 43 provided only on the third plate 21.

The evaporator 1 satisfies a relation of $0.9 \leq P1/P2 \leq 1.1$, where P1 is the passage cross sectional area ($mm^2$) of each portion of the refrigerant discharge passage 23 of the refrigerant inlet outlet member 5; i.e., the passage cross sectional area of each of all the portions of the refrigerant discharge passage 23 in the refrigerant flow direction, and P2 is the passage cross sectional area ($mm^2$) of the pipe which establishes communication between the second refrigerant passage of the expansion valve and the compressor. Preferably, the evaporator 1 satisfies relations of $W1>W2$ and $H1>H2$, where W1 is the internal width (mm) of the upstream end portion of the straight portion 43A of the discharge passage forming second outward bulged portion 43 of the third plate 21 of the refrigerant inlet outlet member 5, H1 is the internal height (mm) of the upstream end portion, W2 is the internal width (mm) of the downstream end portion of the discharge passage forming second outward bulged portion 43, and H2 is the internal height (mm) of the downstream end portion. Further, it is preferred that the rear edge (the edge opposite the refrigerant inlet 9 of the first header section 7) of the straight portion 43A of the discharge passage forming second outward bulged portion 43 be positionally shifted from the rear edge of the refrigerant outlet 11 of the second header section 8 toward the rear side (outer side in the air-passing direction).

Preferably, the internal width W1 of the upstream end portion of the straight portion 43A of the discharge passage forming second outward bulged portion 43 of the third plate 21 of the refrigerant inlet outlet member 5 and the internal height H1 of the upstream end portion satisfy a relation of $0.65 \leq H1/W1 \leq 0.95$.

The straight portion 43A of the discharge passage forming second outward bulged portion 43 of the third plate 21 of the refrigerant inlet outlet member 5 is composed of a pair of side walls 43*a*, a bulging top wall 43*b*, and arcuate connection walls 43*c* connecting the two side walls 43*a* and the bulging top wall 43*b*. Preferably, the straight portion 43A satisfies a relation of $0.25\ W1 \leq R \leq 0.5\ W1$, where R is the radius of curvature (mm) of the inner surfaces of the arcuate connection walls 43*c*, and W1 is the internal width (mm) of the upstream end portion of the straight portion 43A of the discharge passage forming second outward bulged portion 43 of the third plate 21 of the refrigerant inlet outlet member 5.

Further, it is preferred that, from the viewpoint of decreasing the weight, each of the first through third plates 18, 19, and 21 of the refrigerant inlet outlet member 5 have a thickness of 0.6 to 1.2 mm.

Notably, the first plate 18 and the third plate 21 are formed through use of an aluminum brazing sheet having a brazing material layer on each of opposite surfaces thereof. The second plate 19 is formed through use of a sheet made of an aluminum bare material or an aluminum brazing sheet having a brazing material layer on each of opposite surfaces thereof.

The above-described evaporator 1 is manufactured by combining all the components and brazing them together.

The present invention comprises the following modes.

1) An evaporator comprising:

a first header section having a refrigerant inlet at one end thereof;

a second header section disposed to be juxtaposed on the windward side of the first header section and having a refrigerant outlet at one end thereof located on the same side as the refrigerant inlet of the first header section;

a refrigerant inlet outlet member having a refrigerant introduction passage for feeding refrigerant into the refrigerant inlet and a refrigerant discharge passage for discharging the refrigerant from the refrigerant outlet; and an expansion valve attachment member joined to the refrigerant inlet outlet member and having a first refrigerant flow passage for feeding into the refrigerant introduction passage of the refrigerant inlet outlet member the refrigerant having passed through a first refrigerant passage of an expansion valve and a second refrigerant flow passage for feeding into a second refrigerant passage of the expansion valve the refrigerant discharged from the refrigerant discharge passage of the refrigerant inlet outlet member, the refrigerant inlet outlet member being composed of a first plate extending across and joined to the one end of the first header section and the one end of the second header section, a second plate stacked on and joined to a surface of the first plate opposite the two header sections; and a third plate stacked on and joined to a surface of the second plate opposite the first plate, the first and third plates being bulged outward such that bulged portions of the first plate overlap at least partially with bulged portions of the third plate, and the second plate having through-hole-shaped communication portions for establishing communications between the outward bulged portions of the first plate and those of the third plate at required positions, whereby a refrigerant introduction passage whose end located on the downstream side in a refrigerant flow direction communicates with the refrigerant inlet of the first header section and whose end on the upstream side in the refrigerant flow direction communicates with the first refrigerant flow passage of the expansion valve attachment member and a refrigerant discharge passage whose end located on the upstream side in the refrigerant flow direction communicates with the refrigerant outlet of the second header section and whose end located on the downstream side in the refrigerant flow direction communicates with the second refrigerant flow passage of the expansion valve attachment member are provided in such a manner that when the refrigerant introduction passage and the refrigerant discharge passage are viewed in a stacking direction in which all the plates are stacked, the refrigerant introduction passage and the refrigerant discharge passage intersect each other without communicating with each other, the refrigerant flowing out from the refrigerant outlet of the second header section being fed to a compressor through the refrigerant discharge passage of the refrigerant inlet outlet member, the second refrigerant flow passage of the expansion valve attachment member, the second refrigerant passage of the expansion valve attached to the expansion valve attachment member, and a pipe for establishing communication between the second refrigerant passage of the expansion valve and the compressor, wherein a portion of the refrigerant discharge passage of the refrigerant inlet outlet member located on the downstream side in the refrigerant flow direction and having a predetermined length is defined by outward bulged portions provided in the first plate and the third plate and bulging outward in the stacking direction of the three plates, the remaining portion of the refrigerant discharge passage is defined by an outward bulged portion provided in the third plate only and bulging outward in the stacking direction of the three plates;

the outward bulged portion of the third plate of the refrigerant inlet outlet member which defines the refrigerant discharge passage has a straight portion on the upstream side in the refrigerant flow direction, the straight portion having a predetermined length and a fixed internal width over the entire length;

the refrigerant outlet of the second header section faces the interior of the straight portion of the outward bulged portion of the third plate; and a relation of $0.9 \leq P1/P2 \leq 1.1$ is satisfied, where P1 is the passage cross sectional area ($mm^2$) of each portion of the refrigerant discharge passage of the refrigerant inlet outlet member, and P2 is the passage cross sectional area ($mm^2$) of the pipe which establishes communication between the second refrigerant passage of the expansion valve and the compressor.

2) An evaporator described in par. 1), wherein relations of W1>W2 and H1>H2 are satisfied, where W1 is the internal width (mm) of an upstream end portion of the straight portion of the outward bulged portion of the third plate of the refrigerant inlet outlet member, the upstream end portion being located on the upstream side in the refrigerant flow direction, H1 is the internal height (mm) of the upstream end portion, W2 is the internal width (mm) of a downstream end portion of the outward bulged portion of the third plate of the refrigerant inlet outlet member, the downstream end portion being located on the downstream side in the refrigerant flow direction, and H2 is the internal height (mm) of the downstream end portion; and an edge on the windward side of the straight portion of the outward bulged portion in the third plate of the refrigerant inlet outlet member, which outward bulged portion defines the refrigerant discharge passage, is positionally shifted to the windward side from an edge on the windward side of the refrigerant outlet.

3) An evaporator described in par. 2), wherein the internal width W1 of the upstream end portion of the straight portion of the outward bulged portion of the third plate of the refrigerant inlet outlet member and the internal height H1 of the upstream end portion satisfy a relation of $0.65 \leq H1/W1 \leq 0.95$.

4) An evaporator described in par. 2) or 3), wherein the straight portion of the outward bulged portion of the third plate of the refrigerant inlet outlet member is composed of a pair of side walls, a bulging top wall, and arcuate connection walls connecting the two side walls and the bulging top wall; and a relation of $0.25\ W1 \leq R \leq 0.5\ W1$ is satisfied, where R is the radius of curvature (mm) of the inner surfaces of the arcuate connection walls, and W1 is the internal width (mm) of the upstream end portion of the straight portion of the outward bulged portion of the third plate of the refrigerant inlet outlet member.

5) An evaporator described in any one of pars. 1) to 4), wherein each of the three plates which form the refrigerant inlet outlet member has a thickness of 0.6 to 1.2 mm.

6) An evaporator described in any one of pars. 1) to 5), wherein a windward edge of the refrigerant inlet outlet member extends straight in a vertical direction;

an end of the refrigerant introduction passage of the refrigerant inlet outlet member located on the upstream side in the refrigerant flow direction and an end of the refrigerant discharge passage of the refrigerant inlet outlet member located on the downstream side in the refrigerant flow direction are located in a common vertical plane;

a fitting protrusion is provided around an opening of the first refrigerant flow passage of the expansion valve attachment member located on the downstream side in the refrigerant flow direction, and another fitting protrusion is provided around an opening of the second refrigerant flow passage of the expansion valve attachment member located on the upstream side in the refrigerant flow direction; and the refrigerant inlet outlet member has a fitting concave portion whose one end is opened at the windward edge, whose other end communicates with the refrigerant introduction passage, and into which the fitting protrusion of the expansion valve attachment member for the first refrigerant flow passage is fitted, and another fitting concave portion whose one end is opened at the windward edge, whose other end communicates with the refrigerant discharge passage, and into which the fitting protrusion of the expansion valve attachment member for the second refrigerant flow passage is fitted.

The evaporators of pars. 1) through 6) satisfy the relation of $0.9 \leq P1/P2 \leq 1.1$ is satisfied, where P1 is the passage cross sectional area ($mm^2$) of each portion of the refrigerant discharge passage of the refrigerant inlet outlet member, and P2 is the passage cross sectional area ($mm^2$) of the pipe which establishes communication between the second refrigerant passage of the expansion valve and the compressor. Therefore, an increase in the pressure loss on the refrigerant side can be minimized.

The evaporator of par. 2) satisfies the relations of W1>W2 and H1>H2, where W1 is the internal width (mm) of the upstream end portion of the straight portion of the outward bulged portion of the third plate of the refrigerant inlet outlet member, the upstream end portion being located on the upstream side in the refrigerant flow direction, H1 is the internal height (mm) of the upstream end portion, W2 is the internal width (mm) of a downstream end portion of the outward bulged portion of the third plate of the refrigerant inlet outlet member, the downstream end portion being located on the downstream side in the refrigerant flow direction, and H2 is the internal height (mm) of the downstream end portion. Therefore, the stress generated in the outward bulged portion of the third plate can be reduced, whereby a decrease in the strength against the pressure within the refrigerant discharge passage of the refrigerant inlet outlet member can be suppressed.

In addition, the edge of the straight portion of the outward bulged portion of the third plate of the refrigerant inlet outlet member, which outward bulged portion defines the refrigerant discharge passage, the edge being located on the side opposite the refrigerant inlet of the first header section, is positionally shifted outward from the edge of the refrigerant outlet, the edge being located on the side opposite the refrigerant inlet of the first header section. In order to reduce the size of the evaporator, the distance between the end of the first header section located on the outer side in the air-passing direction and the end of the second header section located on the outer side in the air-passing direction is prevented from becoming excessively large. Even in such a case, the above-described relation of W1>W2 can be satisfied relatively simply. Namely, in order to prevent failure of brazing between the third plate and the second plate from occurring on the opposite sides of the straight portion of the outward bulged portion of the third plate of the refrigerant inlet outlet member, it is necessary to make the width of the brazed portion at least two times the thickness of the third plate and the second plate. Also, in order to prevent formation of a short circuit between the refrigerant inlet of the first header section and the refrigerant outlet of the second header section, it is effective to form slits in the three plates of the refrigerant inlet outlet member in a region located between the refrigerant inlet of the first header section and the refrigerant outlet of the second header section. Incidentally, the above-mentioned relation of W1>W2 can be satisfied by a configuration in which the edge of the straight portion of the outward bulged portion of the third plate of the refrigerant inlet outlet member, which outward bulged portion defines the refrigerant discharge passage, the edge being located on the side closer to the refrigerant inlet of the first header section, is positionally shifted toward the refrigerant inlet of the first header section from the edge of the refrigerant outlet on the side closer to the refrigerant inlet of the first header section. However, in this case, if the distance between the end of the first header section located on the outer side in the air-passing direction and the end of the second header section located on the outer side in the air-passing direction is prevented from becoming excessively large in order to reduce the size of the evaporator, it becomes impossible to make the width of portions of the third and second plates brazed together in a region between the first and second header sections at least two times the thickness of the third plate and the second plate, and to form slits in the three plates of the refrigerant inlet outlet member in a region located between the refrigerant inlet of the first header section and the refrigerant outlet of the second header section. However, in the case where the edge of the straight portion of the outward bulged portion of the third plate of the refrigerant inlet outlet member, which outward bulged portion defines the refrigerant discharge passage, the edge being located on the side opposite the refrigerant inlet of the first header section, is positionally shifted outward from the edge of the refrigerant outlet, the edge being located on the side opposite the refrigerant inlet of the first header section, the above-mentioned relation of W1>W2 can be satisfied relatively simply.

In the case where each of the first through third plates of the refrigerant inlet outlet member has a thickness of 0.6 to 1.2 mm as in the case of the evaporator of par. 5), the following problem occurs. In order to suppress an increase in the pressure loss on the refrigerant, at a part of the portion of the refrigerant discharge passage of the refrigerant inlet outlet member formed by the outward bulged portion of the third plate only, the internal width of the outward bulged portion can be increased so as to increase the passage cross sectional area of that part as in the case of the evaporator disclosed in Japanese Patent No. 5142109. However, in such a case, the strength against the pressure inside the refrigerant discharge passage of the refrigerant input outlet member may decrease. However, even in such a case, a decrease in the strength against the pressure inside the refrigerant discharge passage can be suppressed when the relations of W1>W2 and H1>H2 are satisfied as in the case of the evaporator of par. 2), where W1 is the internal width (mm) of the upstream end portion of the straight portion of the outward bulged portion of the third plate of the refrigerant inlet outlet member, the upstream end portion being located on the upstream side in the refrigerant flow direction, H1 is the internal height (mm) of the upstream end portion, W2 is the internal width (mm) of a downstream end portion of the outward bulged portion of the third plate, the downstream end portion being located on the downstream side in the refrigerant flow direction, and H2 is the internal height (mm) of the downstream end portion.

What is claimed is:

1. An evaporator comprising:

a first header section having a first end in a first longitudinal direction of the first header section and having a refrigerant inlet at the first end;

a second header section having a second end in a second longitudinal direction of the second header section and having a refrigerant outlet at the second end, the first header section and the second header section being opposed such that the first longitudinal direction and the second longitudinal direction are substantially in parallel; and a refrigerant inlet outlet member comprising:

a refrigerant introduction passage including a first inlet port and a first outlet port provided downstream with respect to the first inlet port, the first outlet port being connected to the refrigerant inlet of the first header section;

a refrigerant discharge passage including a second inlet port and a second outlet port downstream with respect to the second inlet port, the second inlet port being connected to the refrigerant outlet of the second header section;

a first plate including a first surface, a second surface opposite to the first surface in a stacking direction, the first outlet port provided on the first surface and connected to the refrigerant inlet of the first header section, and the second inlet port provided on the first surface and connected to the refrigerant outlet of the second header section;

a second plate stacked on the second surface of the first plate in the stacking direction and connected to the first plate; and a third plate stacked on and connected to the second plate such that the first plate and the third plate sandwich the second plate, the third plate having a bulged portion which defines the refrigerant discharge passage, the bulged portion having a downstream end portion at the second outlet port and an upstream end portion connected to the second inlet port of the refrigerant discharge passage via the second plate and the first plate, the upstream end portion having an upstream internal width along a surface substantially perpendicular to the stacking direction, the upstream end portion having an upstream internal height along the stacking direction, the downstream end portion having a downstream internal width along the surface, the downstream end portion having a downstream internal height along the stacking direction, the upstream internal width being larger than the downstream internal width, the upstream internal height being larger than the downstream internal height.

2. The evaporator according to claim 1, wherein the upstream internal width is larger than a width of the refrigerant outlet of the second header section, and wherein the upstream end portion of the bulged portion is shifted away from the first outlet port of the refrigerant introduction passage viewed along the stacking direction.

3. The evaporator according to claim 1, wherein the upstream internal width W1 and the upstream internal height H1 satisfy a relationship of $0.65 \leq H1/W1 \leq 0.95$.

4. The evaporator according to claim 1, wherein each of the first plate, the second plate, and the third plate has a thickness of 0.6 to 1.2 mm.

* * * * *